United States Patent [19]

Nelson

[11] Patent Number: 4,553,497

[45] Date of Patent: Nov. 19, 1985

[54] TOW OF BARGES BY TUGS

[76] Inventor: Arthur J. Nelson, P.O. Box 3007, Daly City, Calif. 94015

[21] Appl. No.: 441,751

[22] Filed: Nov. 15, 1982

[51] Int. Cl.[4] ..... B63B 21/56

[52] U.S. Cl. ..... 114/246; 114/253

[58] Field of Search ..... 114/253, 246, 251, 254, 114/249, 250; 24/115 R; 280/480, 491 F, 490 A, 477, 492; 244/1 TD, 3

[56] References Cited

U.S. PATENT DOCUMENTS

| | | | |
|---|---|---|---|
| 3,336,895 | 8/1967 | Nelson | 114/246 |
| 3,407,778 | 10/1968 | Epstein | 114/253 |
| 3,492,964 | 2/1970 | Garcia | 114/251 |
| 3,611,977 | 10/1971 | Mosvold | 114/246 |
| 3,745,958 | 7/1973 | Nelson | 114/246 |
| 4,080,921 | 3/1978 | Freitag | 114/249 |
| 4,275,677 | 6/1981 | Nelson | 114/246 |

*Primary Examiner*—Galen L. Barefoot
*Assistant Examiner*—Patrick W. Young

[57] ABSTRACT

A readily alterable arrangement, to suit the need at sea and in coastal inlet passages for control and disposition of vessels, comprises: pulled barges outfitted with a condition responsive linkage mechanism for implementing a rudder, towlines conveying propulsive force to barges, and tugs continually employed in tow or exchange of barges being loaded/unloaded in the interim of tug port calls. The linkage mechanism, dependent upon a pivotal beam mounted forwardly of the barge mass center, imparts propulsive force on the longitudinal centerline or at either barge side as transmitted to the pivotal beam ends by a bridle leg arranged towline terminal. Alternative assemblies comprise: coupled bridle legs by a flounder plate for a single towline to effect automatic barge control at sea, connection of bridle legs as separated extensions for dual towlines adjustably lengthened for selective control of barge rudders in sheltered waters and employing dual towlines for double tow of barges automatically controlled at sea. The arrangements also comprise a system to effect changes from one to two towlines, a system to interchange barges and system to back and moor barges—all to provide an operative arrangement adjusted to the sequence of encounters to complete a voyage.

4 Claims, 23 Drawing Figures

Fig 7
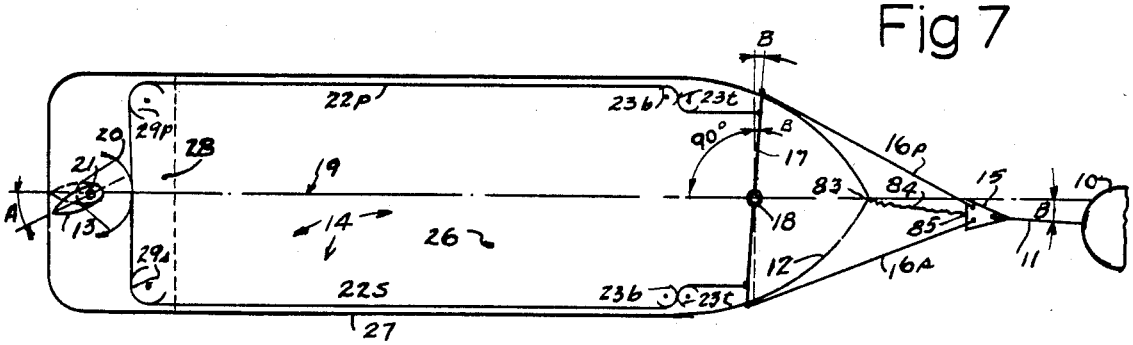
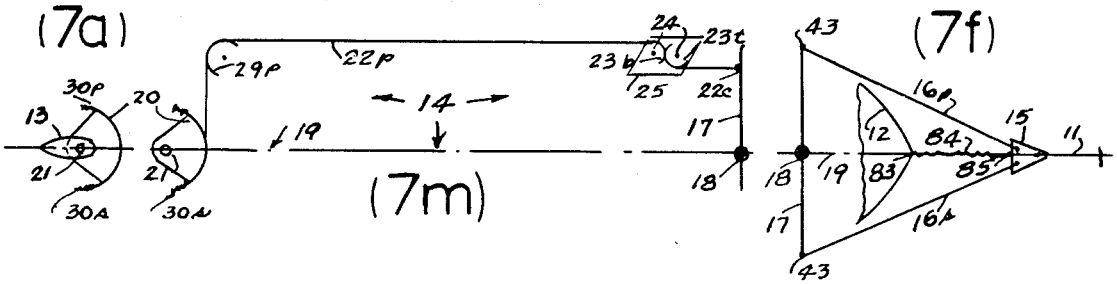
Fig8
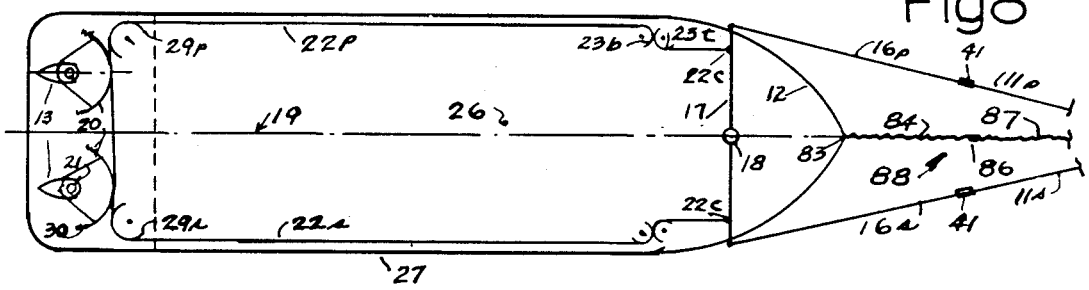
Fig20 Fig19
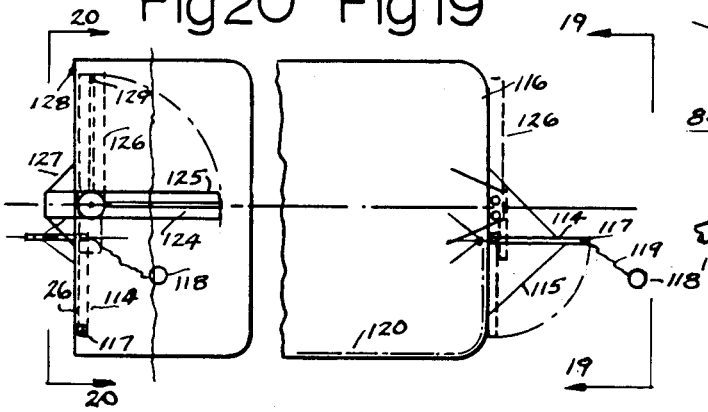
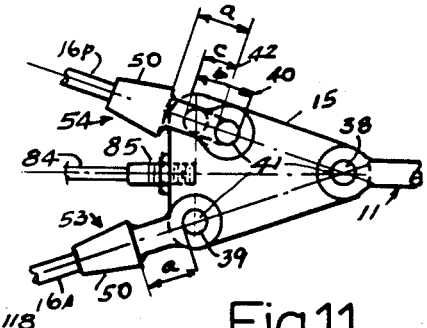
Fig11

51
13
50
57
62
68
16a
52
56
61
67
58
16p
13
50
46

12
16a
s
61
16p
57
62
49
65
64
50
47
50
R
63
12
s
60
53
a
48
85
p
54
42
40
39
a
15
55

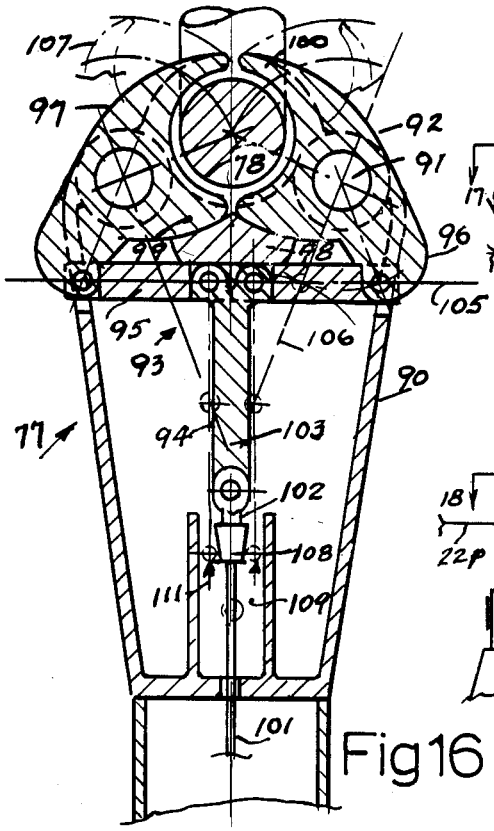
Fig16
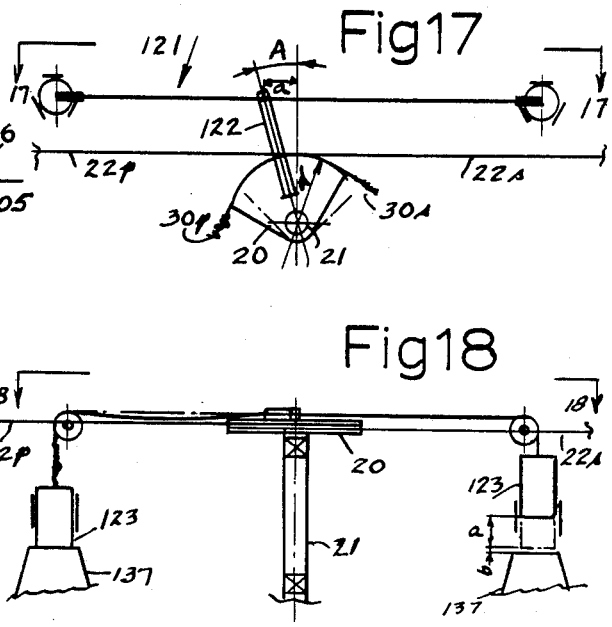
Fig17
Fig18
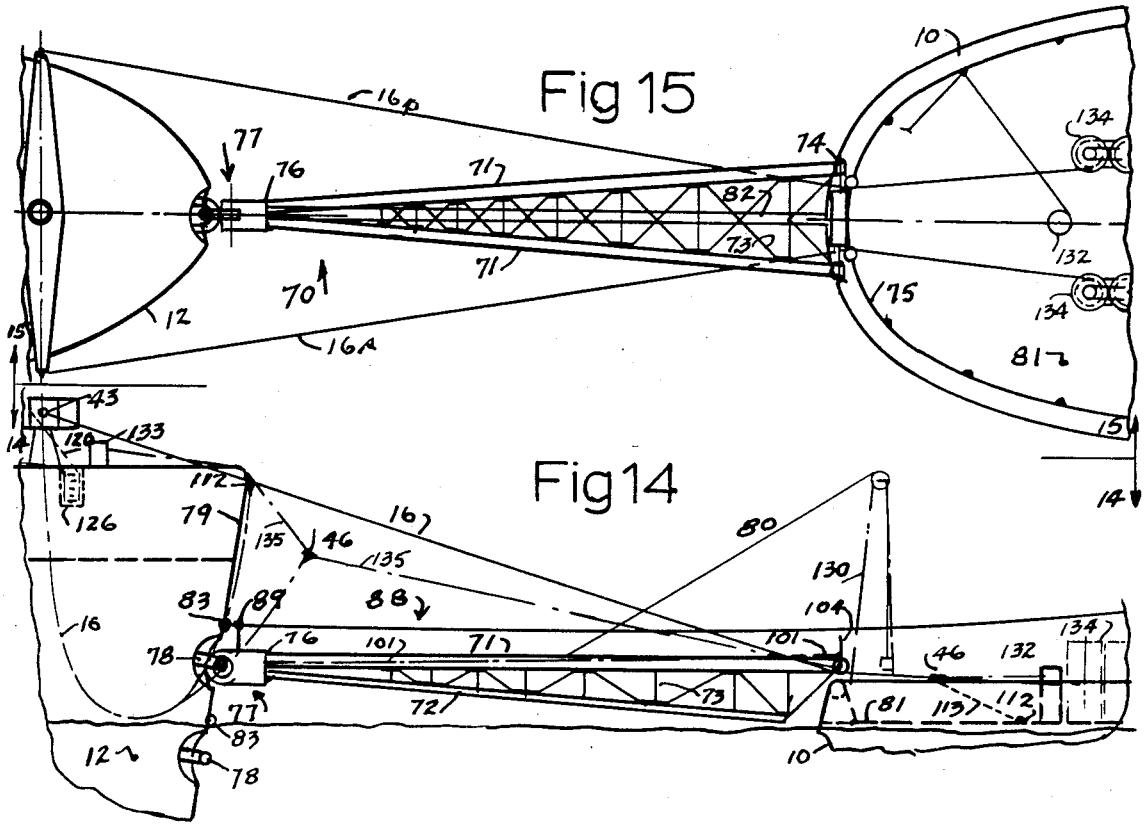
Fig 15
Fig14

TOW OF BARGES BY TUGS

CONTINUATION-IN-PART OF REFERENCE "D" BELOW

CROSS REFERENCES AND IMPORT OF THE PRESENT APPLICATION TO THEM

Ref.(A), U.S. Pat. No. 3,336,895, 8-22-67, Yaw Control of Towed Barge Ref.(B), U.S. Pat. No. 3,745,958, 3-23-73, Control of Towed Barges Ref.(C), U.S. Pat. No. 4,275,677, 6-30-81, Tow of Barges by Tugs Ref.(D), Divisional application No. 273,604, Abandoned.

The present application pertains to an improved arrangement of the linkage mechanism which more aptly adjusts to a need, simplified installation and lessens construction costs. This application contends with completing a voyage requiring various arrangements, alterable enroute, to suit encounters at sea and coastal inlet to optimize safety and minimize incidents of obstruction, damage and injury. The format adopted herein established enumerated arrangements with correspondingly figured drawings which are delineated one time for connotation of its use when applied in the disclosure and establishes distinction among 6 arrangements.

BACKGROUND OF THE INVENTION

1. Field of the Invention

The present application related to the mode of transporting waterborne cargo by fulfilling the dual time consuming function, to bear and move cargo, as separated functions undertaken by vessels applied solely for the one specific function. The basic concept pertains to a train of vessels: led by a tug to provide motivation of the train, and towed unmanned barges formed with shipshaped forebodies and having stern mounted rudders providing directional control of barges as monitored by towlines interconnecting tugs and barges.

Operator demands in addition to a patent requirement to be novel, useful and operable are that equipment be reliable, productive and especially, to be simple to construct and maintain. A pivotal beam is the crux of the system, providing diverse arrangements to control and regroup barges in a train destined for several ports in a voyage, being the combinator of propelling and steering elements and serves as the intermediary in the linkage with the towline to implement the rudder.

2. Description of the Prior Art

Self-propelled, self-sufficient ships perform said dual time consuming function sequentially for a cumulative time lapse to foster the sense of haste. Configuration of the ship hull to accommodate the stern mounted propeller, propelling and steering gear, sundries to effect self-sufficiency, speed to handle cargo and cover distances—are all detractive factors to productivity and conservation of energy.

Subsequent development of barges with skegs and "pushed" barges aborted best features of its precedent to nullify advantages sought. Despite advent of the 'Kort' nozzle and controllable pitch propellers, innovations have been only minorly benefitting moderately sized cargo vessels. The principal fault is the mode of propulsion with the propeller aft to push vessels—charged with numerous adverse factors Contrarily, despite prejudiced notions, the tenacity of towlines to fulfill its function—to pull barges—is excellent, as attested by: its required inclusion with "pushed" barges as the means to be used in heavy weather, and its good service record towing skeg fitted barges despite abuses and improper use.

SUMMARY OF INVENTION

The mode of exchanging barges at a port allows for a time concurrent operation of tugs continually employed to move barges while cargo is being worked with other barges to be entrained. A more orderly and sensible operation develops, to avoid the sense of haste, lessens concern over port consequentials, and affords time to care for 'gear' between stages working cargo in the interim of tug port calls to effect barge exchanges.

The practice to exchange barges is made economically feasible because of merits with the linkage mechanism which restores use of the shipshped forebody and rudder to towed vessels. A simpler full formed barge afterbody, without concern for water flow to propeller aft, improves seakeepiness to ameliorate pitching to lessen slamming of the less susceptible forebody. A resultant increased displacement is augmented with increased cargo capacity by supplementing burdensome appurtenances of self-propelled manned ships with the insignificantly weighing linkage mechanism.

Consequently, a single tug and barge fitted with the linkage mechanism transports annually a third more cargo, bears half the labor cost, consumes about a fourth the fuel oil than a ship sized with the barge. Multiple tow of barges even more outstrips performances of more numerous ships.

A prime object is the overall performance of a train of tugs and barges achieved by alterable train arrangements for control, disposition and regrouping barges.

A principal object is relocation of the pivotal beam to simplify its mounting upon a barge and to facilitate selective arrangement of the linkage mechanism between towline and rudder.

Another object is to adapt said selective arrangement for its elements to be disposed to isolated locations free of interference to cargo handling or its disposition while maintaining watertight integrity of hull and compartmentation of holds.

Another object is to provide the operational means needed to achieve the said prime object, the basis of the present application.

Another object is to provide an 'A' framed pivotal extension from the tug stern expeditiously connected to the barge bow (stem) to facilitate maneuvering and manning the barge to and from a dock.

Numerical List of Expressions (Defined)

Six arrangements are enumerated and defined for a subsequent simplified expression of its practice and to clearly distinguish the mode of assembly. The basic arrangement of the linkage mechanism common to all arrangements is reviewed subsequently to precede "General Description."

Arrangement (1)—AUTOMATIC BARGE CONTROL—the simplest arrangement employed at sea with a flounder plate connecting a towline to equal length bridle legs mounted to the ends of said pivotal beam for a constant configured assembly of the towline to the pivotal beam.

Arrangement (2)—DOUBLE TOW—a simple change to Arrangement (1), being: double tow of the barges each by a towline effecting automatic barge control, whereby barges are caused to trail oppositely off the center of the tug wake, one aft of the other with the near barge clear of the more extended towline, and the two barges independently respond directionally in oblique, parallel spaced patterns with miniscule yaw deviation for directional stability.

Arrangement (3)—SELECTIVE CONTROL—the tow of a barge in coastal inlets (sheltered waters) by two towlines connected as extendable lengths of separated bridle legs to afford selective manipulation of the barge rudder by duplicate traction winches aboard the tug to divert the barge at will.

Arrangement (4)—SUPPLEMENTAL CONTROL—this practice is applied with above Arrangements (1, 2 & 3) to augment a rudder's ability to turn a barge, a shift in location of applied propulsion:

(a) This occurs automatically when the tug changes heading substantially to cause the single towline of (1 & 2) to act through a single bridle leg (the other relaxed). A stop limits the amount of deflection of said pivotal beam to alter the constant figured Arrangement (1 & 2), so that propulsion shifts to a barge side from the central location of (1 & 2) to create a turning couple assisting the rudder at maximum deflection to turn the barge.

(b) This applied selectively with two towlines of Arrangement (3) when one towline is relaxed, moderately or completely, for a dominant amount of propulsion applied to one barge side to create a like assisting turning couple of Arrangement (4*a*).

Arrangement (5)—INTEGRATED TOW—a tug is effectively lengthened by a pivotal 'A' frame mounted on the tug stern rail for universal connection to a selected one of a number of padeyes fixed to the barge bow (stem), depending upon the barge draft, to effect substantially a horizontal frame position. Towline Arrangement (4*b*) applied as adapted for the prior and subsequent performance with maneuvers in sheltered waters to and from a dock ameliorating conditioning forces.

Note the sequence of performances: Arrangement (1) or (2) at sea, changed to Arrangement (3) in confining passages, then changed to Arrangement (5) in mooring the barge, having resorted to Arrangement (4) with the need.

Arrangement (6)—TRIPLE TOW—a leading tug in tow of a barge assists a second tug in double tow of barges as a train to become separable in passing a port; for the lead tug and barge to effect exchange of barges, while the double tow continues on course to be overtaken by the single tow with the exchange barge. As arranged the overtaken tug then becomes the leading tug to assume the arrangement first established for a subsequent reoccurrence of a single tow into a port for the second barge exchange.

DESCRIPTION OF DRAWINGS

The first six figures are plan views diagramatically illustrating, exaggerated for a better visual image, progressive positions in undertaking a tow as set forth in the numerically listed arrangements.

FIG. 7 is a plan view schematically showing a tug in tow of a barge having a linkage mechanism connecting a single towline to a rudder for implementation per Arrangement (1). Sketches *7a, 7m* and *7f* are free body diagrams as segments of the linkage mechanism.

FIG. 8 is a plan view schematically showing a barge towed by dual towlines with the linkage mechanism, incidentally, connected to dual rudders.

FIG. 11 is a plan view of the flounder plate with portions of wire members.

FIG. 14 is an elevation view of the 'A' frame integration of tug and barge taken from 15—15 of FIG. 15.

FIG. 15 is a plan view of the 'A' frame assembly taken from view 14—14 of FIG. 14.

FIG. 16 is a cross sectional view of the universal clamp assembly.

FIG. 17 is a plan view diagramatically illustrating the return to neutral system of the rudder with towline relaxed.

FIG. 18 is an elevational view 17—17 of FIG. 17.

FIG. 19 is a partial plan view diagramatically illustrating appurtenance arrangements to the stern of a barge.

FIG. 20 is an elevational end view of a barge taken 19—19 of FIG. 19.

CONCEPT (FIG. 7)

Figure 1:
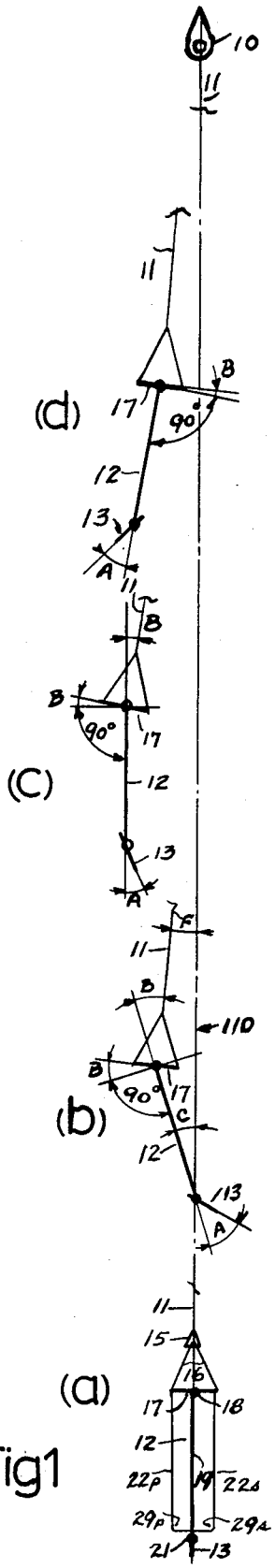
FIG. 1, Arrangement (2), aligned position (a) changes to positions (b, c) with yaw to port establishing a right rudder for return toward course by position (d), for a subsequent repeated aligned position (a) on course, to have avoided overshooting the course with the left rudder reducing to neutral with approach on course.

The basic concept is a linkage mechanism established to a regular configuration comprising aligned members, which when transformed by external behaviors, activates a rudder to maintain directional stability of a barge being towed by a tug with a towline.

The towline is virtually the monitor of the system, being the connecting member of the two vessels. Tug heading change or barge sheer (yaw) off-course (the external behaviors) effects misalignment between towline and barge, thereby transforming configuration of the linkage mechanism comprised of three segments.

For the posture of automatic directional stability in contention with barge yaw off-course set by the tug, the forward segment (of the three) retains a constant configuration of towline with bridle connected to the ends of a pivotal beam fixed above deck on the longitudinal centerline and forward of the barge mass center.

The pivotal mounting of the forward segment (*7f*) retains said constant configuration through unrestraint relation to a maximum angular deflection (B) when the forwardly moving beam end abuts a stop. This stop fixes maximum rudder angularity (A) and transposes propulsion from the pivot axis to the barge side by the behavior of the tug to change course. Configuration of the forward segment has then been changed to relax one leg of the bridle and fix the other bridle leg as a direct extension of the towline.

The directional control after segment (*7a*), having a bearing supported rudder stock to provide for the pivotal mounting and torsional resistance between a rudder quadrant and said rudder, is relieved of hydrodynamic torsional loading with the limited angular deflection (A) containing the center of pressure of water to act along the pivotal axis.

A pair of aft wires extend, symmetrically arranged for the mid segment (*7m*) of said linkage mechanism 14, from a forward end connection with the above deck pivotal beam to a rearmost below deck compartment having grooved sheave segments about which the aft wires bend for an athwartship reach past each other to adjustable connections with the pivotal rudder quadrant. Said quadrant is disposed forwardly of its rudder stock.

These aft wires are pretensioned and adjusted to establish a regular mid segment configuration with the pivotal beam established at right angles to the rudder then set aligned with the barge centerline and tensioned towline.

Sheer of the barge off-course (yawing) alters the barge alignment with the forward segment to establish the angular deflection (B) between the pivotal beam and a tranversal through the pivot axis. Geometrically the angular deflection (B) is the same for the towline misaligned departure from the barge centerline. Angular departure (C) of the barge off-course and a resulting disposition of the towline off-course for a deflection angle (F) are triangularly related as ($B=C+F$). See Ref. (C).

The composition and configuration of a unified system, comprising two pivotal members, provides for miniscule deflections of the propulsion force transmitting forward segment for amplified deflection of the directional controlling after segment. Instantaneous response by the simple linkage mechanism when transformed by external behaviors minimizes those deflections for a rudder performance with least drag. Contrarily, a ship rudder dependent upon propeller wash, is sized to cope with turning circle demands, suffers time lag because of servo-mechanisms and delayed application with perplexities of human behavior(individually or communicatively).

VESSEL OUTFITTING

Conventional outfitting for the tug and as disclosed for the barge are augmented by prime appurtenances facilitating changes in said arrangements to cope with encounters during a voyage. Accordingly;

(a) tug 10 having: a powered controllable pitch propeller; auxiliary power for a bow thrustor, a capstan 132 with auxiliary towline 131, dual traction winches 134 each having a towline 11; an 'A' Frame 70 pivotally mounted 74 to the tug after deck stern rail 75; a travelling crane means to lift and move heavy parts; a portable derrick 130 likewise mounted and adjacent to the 'A' frame and having a winch operated wire 80; and, a reel contained extendable wire 87 with coupling means 86 as portion of a wire system, noting four (wire) systems are being disclosed;

(b) barge 12 having: a mechanism 14, a first series of light duty padeyes 83 at the barge stem 79 for a selected one end connection of a stub length wire 84; heavy duty padeyes 78 establish a second series with each one immediate to and beneath a said light duty padeye; a pair of equal length, socket ended, pin connecting bridle legs 16 oppositely arranged as connected 43 to said mechanism with the other ends 53,54 extending forward of the barge; a flounder plate 15 being the vertex connecting means between the towline distal end pin 41 connecting means and said bridle legs; cufflink 46 with anchor chain 113 featured.

Appurtenances—Structural Disclosure

Founder Plate 15 (FIG. 11)

The flounder plate 15 is detailed as preferred from several versions accomplishing the same purpose. End fittings of towline 11 and socket ended bridle legs 16 mate, being connected together by pins 41 (viewed in FIG. 8). Therefore, more of the same pins 41 serve to connect the flounder plate 15 between fittings with holes 38–39 accommodating fittings of towline 11 and a bridle leg shown 16*s*. Slotted hole 40 accommodates the other bridle leg 16*p* with a filler plug 42 match fitting the gap in the slot with the pin 41 in place, Filler plug 42 is alternatively disposed to either side of pin 41 in slot hole 40. With pin 41 bearing on the slot the bridle leg assemblies are equal. With pin 41 bearing on plug 42 the bridle leg assembly is shortened whereupon with propulsion by the tug, the beam 17 sets to an angular departure (B) to provide an oppositely rotated set of the rudder for angular departure (A) as shown exaggerated in FIG. 2*a*. The offset rudder changes barge heading to track with the shorter leg more midstream of the tug wake. A like assembly with the flounder plate 15 turned upside down establishes a like internally fitted barge to the opposite side of said midstream location.

Figure 13:
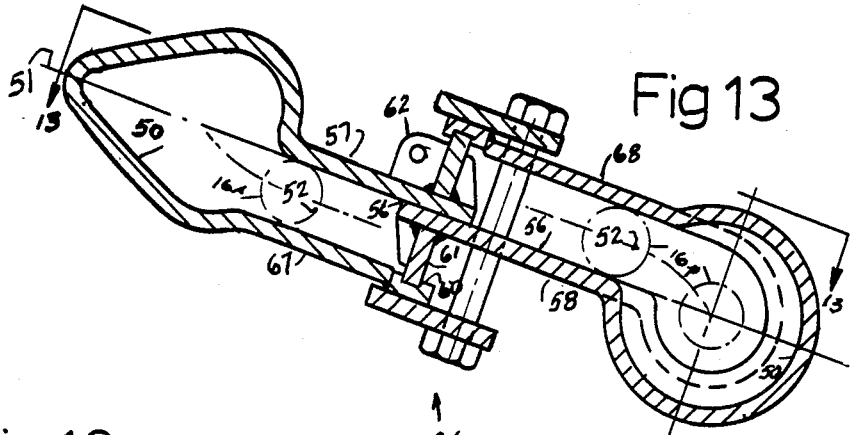
FIG. 13 is an end view of the cufflink taken from section 12—12 of FIG. 12.
Figure 12:
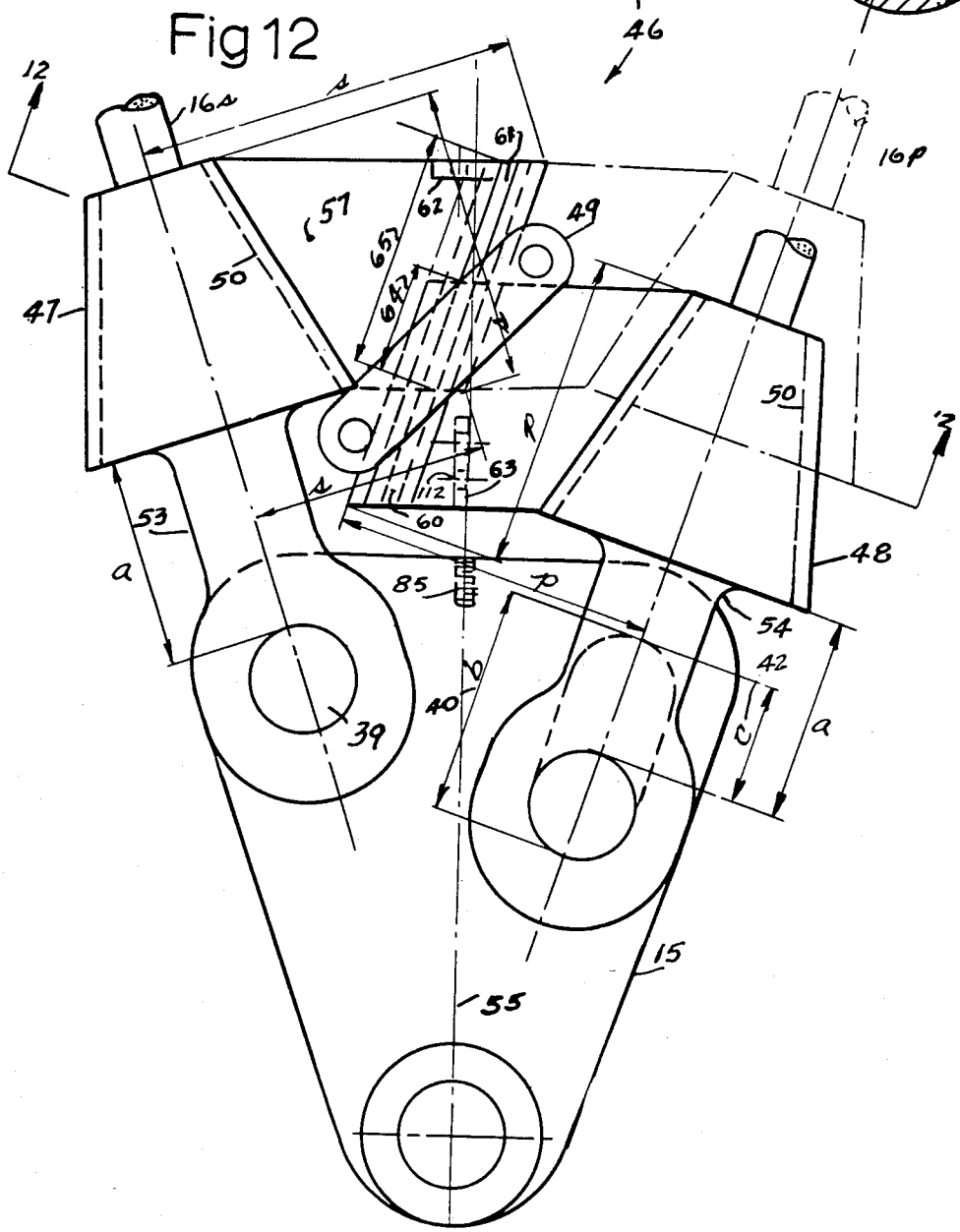
FIG. 12 is a plan view of the cufflink coupling socketed ends of bridle legs.

Cufflink 46 (FIG. 12–13)

Cufflink 46, associated with drill hole 39 and slotted hole 40 of flounder plate 15 is slidably assembled together as two halves, having a first applied cone segment 47 (sided with hole 39) and a second applied cone segment 48 (sided with slot 40) and is held together by strongback 49. Cone segments are formed to seat the conical portion 50 of either bridle end socket 53,54 having saddled the bridle wire 16 by channel 52, laterally clear before being said assembled. First bridle socket 53 and second bridle socket 54 are assembled to flounder plate 15 to an approximate vertex angle of 37° to establish an 18½° angular set of cones of said segments each side of the cufflink axial centerline 55. In FIG. 13 channels 52 of both cone segments mismatch mate with plain faced faying surfaces 56 within channels 52 occurring on transverse centerline 51 common to like cone sections.

Channel walls 57, 58 (with faying surfaces) extend differently from cone sections to establish adequate bearing engagement area 64 aligned parallel to the 18½° angularity of the conical section of cone segment 48. Channel walls 67, 68, establishing channels 52 with faying surfaces 56 along centerline 51, extend parallel with walls 57, 58 respectively to provide interior grooves 60 for engagement with tongue 61 fixed to back of walls 57, 58; so as to be exterior to the channel formed by it. Tongues 61 bridge the span between walls with said assembled two halves to close off channels and transmit strongback compressive force centrally to said area 64. Opposing loads between sockets 53, 54 are contained by the assembled cufflink 46 as specified to be employed.

Figure 2:
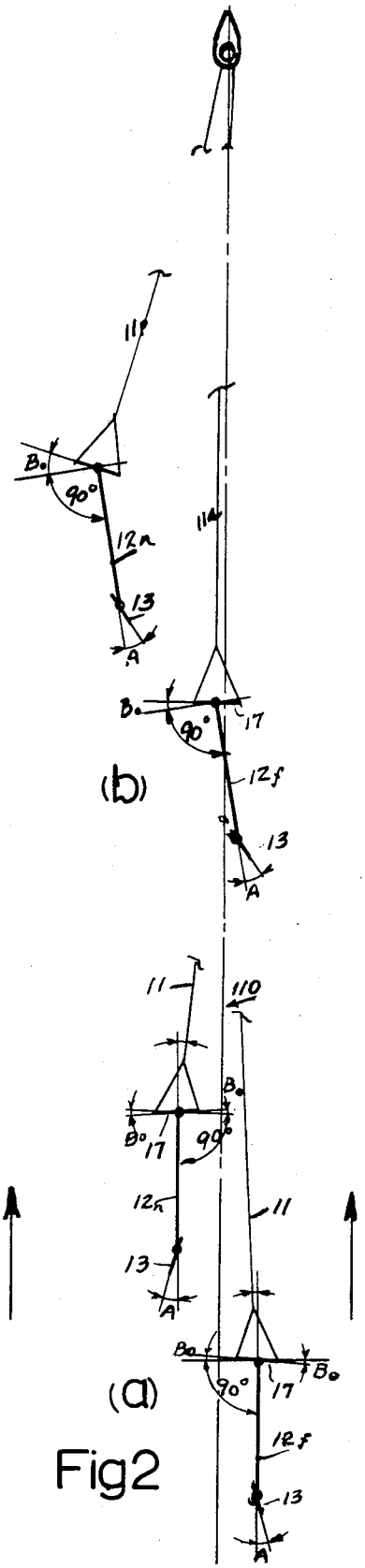
FIG. 2, Arrangement (2), position (a) shows barges (double tow) tracking on course each to a side of the wake centerline: the far barge (f) with slight right rudder and the near barge (n) clear of the more extended towline with left rudder. Position (b) shows both barges at a port yaw for a parallel oblique setting with right rudders for return on course, individually repeating performance (1*d*) to a reinstated position (a).
Figure 3:
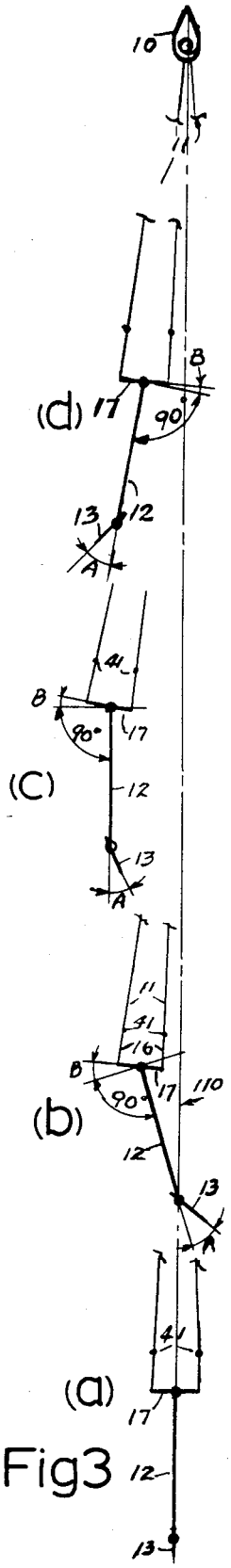
FIG. 3, Arrangement (3) (the subsequent arrangement in sheltered and in narrow tortuous passages from that of FIG. 1 at sea) shows from an aligned position (a) the barge has been diverted to position (b) to avoid an obstruction detected by the tug ahead, with positions (c & d) being again the approach to an on course position accomplished by selectively manipulating the barge rudder.
Figure 4:
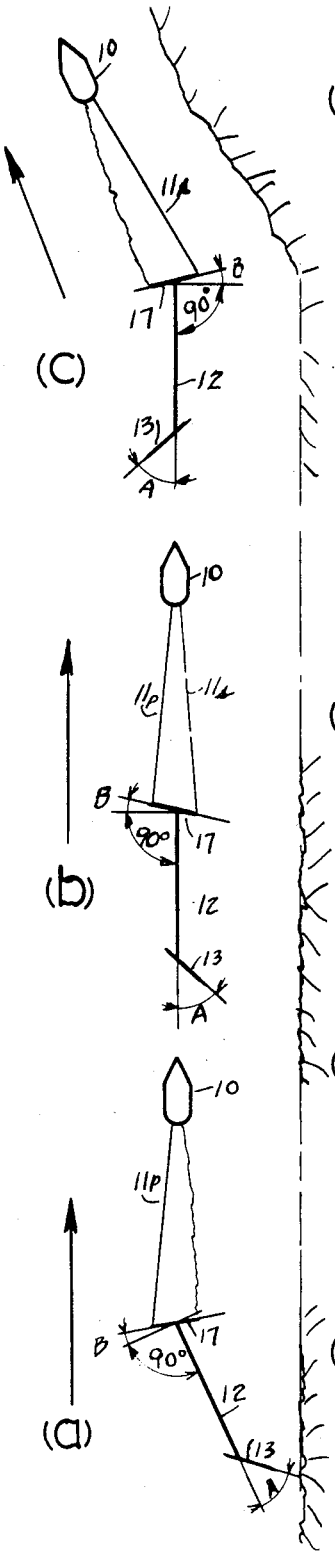
FIG. 4, Arrangement (4), position (a) represents the effect with a single towline of Arrangement (1), and also for Arrangement (2) not show, with pronounced change in tug heading to starboard with the starboard side bridle leg slack. Maximum right rudder has been set with the towline a direct extension to the barge port side. Position (b) shows the effect of Arrangement (4*b*) to negate the stern "suction" effect in narrow channels with the tow off mid-stream. The starboard towline is relaxed for a right rudder with propulsion by the port towline opposing shear to the far side bank. Position (c) indicates a controlled tow paralleling a near bank with maximum left rudder and the starboard towline tensioned—port towline slack.

FIG. 12 is detailed, for Arrangement (2) FIG. 2, with the filler plus 42 establishing socket 54 for a shortened bridle leg 16*p*. Consequently, cone segments have a less bearing engagement area 64 than occurs had the filler plugs been rearranged for like length bridle leg extensions for the fully engaged area 65. Like lettered dimension lines graphically distinguish walls extension and bearing areas associated with its cone section and subscripts identify like members differently arranged.

'A' frame to (FIG. 14–15)

FIG. 14 shows main lengthened chord members 71, 72 braced by web members 73 to establish a structure having cantilever truss like characteristics resisting horizontal components of loading. The more broadly spanned end of main members 71 (see FIG. 15) are pin connected 74 to the tug stern rail 75, whereas the distal flanged end 76 extended by articulatively operated clamp means 77 is engaged for universal connection to one of a series of heavy duty padeyes 78 fixed to the barge stem 79, selected per Arrangement (5). Aluminum pipe is used to construct the 'A' frame.

The inextensibly connected vessels, as integrated by the 'A' frame end mountings, establishes a need to be lengthily spaced apart. Those mountings are provided by said vessels variously responding to modulated swells as acceptable at a dock location. Various angular set of the 'A' frame with differing elevational set of mountings establishes a correspondingly changing horizontal spacing between vessels. Thus, with a lengthened 'A' frame said changing spacing is contained to scarcely perceptible surging of vessels, primarily the tug.

With this discussion of the 'A' frame length the auxilliary purposes are included herewith as antecedent for subsequent discussions. To integrate vessels, mating parts need be in alignment. The distal end of this 'A' frame establishes a lever arm length with the tug's pivotal axis forward of said stern rail; which becomes a couple with a force impressed at said end. The couple overcomes the tug's immersed lateral plane area resisting to be turned. That couple is established by a lessened force exerted by a fail-safe means subsequently discussed.

As employed only in sheltered waters to moor and exchange barges at a dock, the lengthy 'A' frame avoids any possible vertical jackknifing together of vessels by a rogue sea encroahment thereto. The essentially horizontal containment and ameliorated motion of the connecting 'A' frame provides a catwalk safe means for a crewmember to serve aboard either vessel as required.

Portable Derrick 130 (FIG. 14)

Derrick 130 is similarly hinged and located adjacent to the 'A' frame 70 to elevationally dispose a winch controlled wire 80 and is similarly disposed to a prone position with the 'A' frame for arrangements (1–4 and 6). Tensioned wire 80 serves to pivotally swing the 'A' frame for an outboard reach of end clamp 77.

Said disposed wire 80 is fastened to approximately midlength of the 'A' frame to swing and selectively elevationally vary the outboard positioned 'A' frame and to provide semisupport of the 'A' frame when connected between said mountings with means to suitably counterweight the load on said winch.

Clamp 77 (FIG. 16)

Articulative clamp means 77 comprises: body 90 with drilled holes for pins 91, a linkage means 93, activated to cause jaws 92 to pivot about pins 91, comprises a tee formed member 94 pin connecting dual intermediate links 95 which in turn are pin connected to lever arm portions 96 of jaws 91. With jaws 92 in closed position 97 around padeye 78, said dual intermediate links 95 are axially aligned with tee member 94 interposed to establish a self-locked in columnar position 105. Compression in frame 71 to back the barge is transmitted through body portion 98 to padeye 78 with jaw portion 99 therebetween. Tension in frame 71 to tow the barge is transmitted to padeye 78 by jaws 92 locked from being pivotally opened by counteracting lever arm portion 96 pin connected to linkage means 93 in columnar position 105 opposing forces acting on the enclosing jaw position 100.

A wire 101 with socketed end 102 is pin connected to shank portion 103 of tee member 94 with said wire 101 tensioned by a remotely located lever 104 of FIG. 14 to draw member 94 from a columnar position 105 to an extreme alternative position for axial alignment 106 of intermediate link 95 with pin 91 and pin connecting tee and intermediate link 94, 95 respectively for an extreme open jaw position 107.

Socket 102 is secured to a bar 108 extended through guide slots 109 formed through walls of body 90 for connection to compression set spring assemblied 111 to load the columnar position 105 against body portion 98 to secure said locked position against inadvertent jaw opening. Tensioning said wire 101 represents increased compressive loading of spring assembly 111 to open jaws for position 107.

Intervening Means to Establish a Fail-Safe Concept

Stub aft wire portion 84 has a length fixed by the sag in its suspended arrangement between connections at light duty padeye 83 and flounder plate 15 connection 85 of FIG. 7. This first wire system 84 is the interim assembly for arrangements (1–2 & 6). The common one end connection 83 serves four (wire) systems required to sustain a fail-safe means and in exchange of barges.

The extendable wire portion 87, stored on a reel aboard the tug during said interim assembly, when joined to wire portion 84 by coupling 86 establishes second wire system 88 for arrangement (3). The said reel is paid-out to maintain a sag between connected ends of system 88 as extended to suit traction winch disposition of the barge aft of the tug.

Aft wire portion 84 is heavier sectioned than wire portion 87 which establishes the load to determine the said light duty padeye 83. Wire 84 is approximately 100 feet long, approximately the span of the flounder plate forward of the barge. Wire 87 is approximately 1000 feet long.

Travelling Crane (Commonly Purchased Item)

Said crane is a conventional rail suspending, lifting means depending from the prone positioned 'A' frame catwalk; simply adapted. In prone position the 'A' frame extends from said stern rail to the tug house where said distal end suspends. Members 71 rest on more than two deck fixed pedestals and are secured thereto. Crane rails extend forward for a portion of the catwalk length. The remainder, separated portion from the catwalk, extends to said house as braced from the deck. Said separated portion provides for a secured storing of the crane with the 'A' frame outboard.

The intermittently used flounder plate when stored aboard the tug is at a securing fixture adjacent with the tug stern rail. Thus, with the 'A' frame outboard and free of said crane, the flounder plate is in position to have lines coupled to it as required to transfer the bridle and aft wire portion 84 to the barge being left. Transfer of these barge appurtenances being effected by lines 135 as powered by capstans 132–133 (FIG. 14).

Appurtenances-Function and Utility

Founder Plate 15

Flounder plate 15 provides for the intermittent engagement means of towlines and aft wire portion 84. While the discussion has placed the flounder plate as a barge appurtenance, it may as well be taken as a tug appurtenance in view of the adaptability of the cufflink to be singly used.

As the vertex connection for bridle legs the flounder plate affords the advantages of double tow of barges by disposing the two to opposite sides of midstream of the tug's wake. The purpose is to avoid abraiding the towline of the more aft disposed barge by the more forward barge. As devised, the change to single tow is a matter of relocating the filler plug 42 in slotted hole 40.

Cufflink 46 (FIG. 12–14) accommodatingly serves to engage socketed end fittings of bridle legs 16 as an anchor means 112, 113 to assume load imposed with slack-off by towline 11 to allow a change in said arrangements for direct coupling of a towline to each bridle leg (with second wire assemble 88) with the flounder plate and cufflink stowed aboard the tug. A pad 63 double drilled and fixed to the back of wall 58 provides for mounting anchor chain 113 to be alternatively connecting the cufflink assembly to the deck of a tug or a barge (FIG. 14). Two flexible hauling lines 135 are connected to the second of said drilled (holes) and used in barge exchange to transfer the flounder plate and cufflink connecting bridle legs between tug and barge to store the bridle above water as catenary like curved wires as suspended from upper-reaching connections at the barge stern 79 and beam ends 43. A padeye 62 fixed to the back of wall 57 provides for the temporary connection of wire portion 84 uncoupled from third wire assembly 188, subsequently disclosed; whereupon the resulting fourth wire system 184 retains the potentiality of barge exchanges by a fail-safe means.

Figure 5:
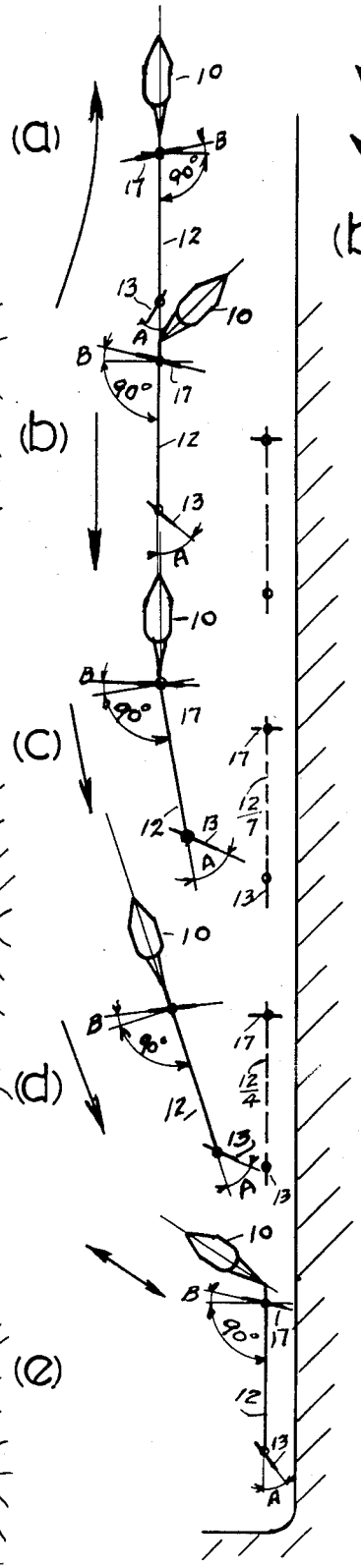
FIG. 5, Arrangement (5), is more illustrative of the backing capability of the integrated tow assumed in approach to a dock and providing unassisted (no other vessel) mooring of barges particularly in contention with restricting conditions and the elements. The method provides for selective alignment or angular set of the said lengthened tug by its bow thrustor with respect the barge position in a jackknife sequence with sternward backing of the barge. Position (a) indicates the forward approach of a dock site to establish a stern spring line and set an anchor when necessary to hold against wind or current forces. Position (b) shows the change in barge angularity as backed by the tug assisted minorly with the barge rudder. Positions (c & d) depend upon the swing of the spring line to pull the barge stern to the dock with the tug alignment altered to bring the barge bow to the dock. Position (d) indicates the arrangement for the completed performance or initial position with a second barge in the exchange practice.
Figure 6:
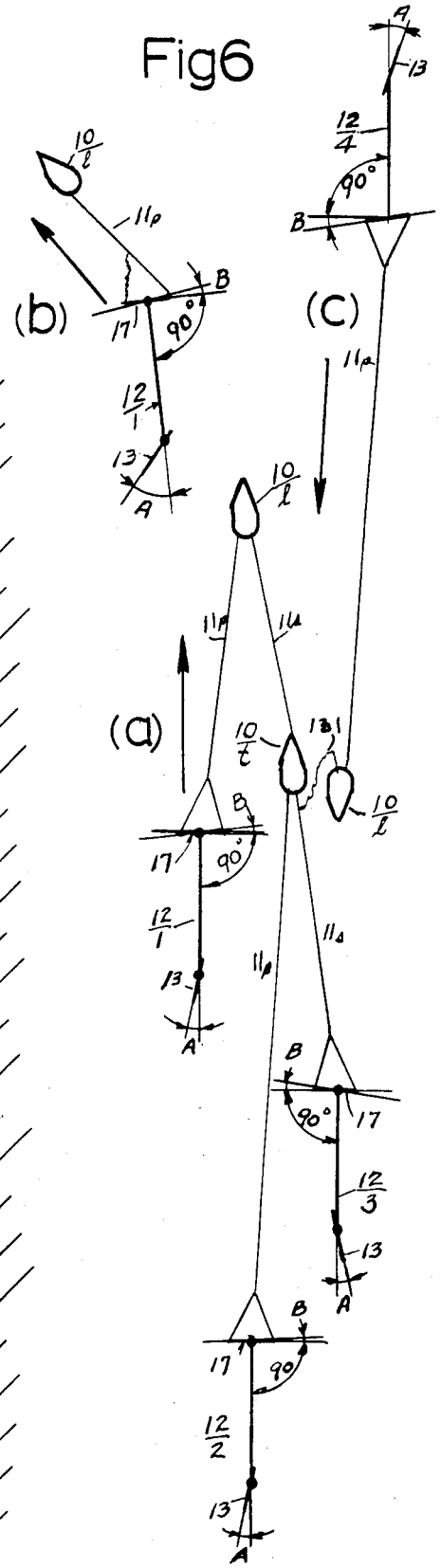
FIG. 6, Arrangement (6), triple tow of barges is an adaptation of Arrangement (2) with two tugs for three barges. Position (a) shows the combined tow as a train on course with the lead tug (1) in tow of a trailing tug (t) close hauled and a barge (1) more distantly towed. The trailing tug (t) is in double tow of far barge (2) and near barge (3). Position (b) shows tug (1) with barge (1) now close hauled and separated from tug (t) for diversion to a port to exchange barges for regrouping to the train. Tug (1) with barge (1) now close hauled and separated from tug (t) for diversion to a port to exchange barges for regrouping to the train. Tug (1) will have changed, sequentially, Arrangements (1-3-5-3-1) in the interim when not part of the train to indicate the need for apparatus to expeditiously and safely perform numerous changes many times in serving many ports annually. Position (c) shows tug (1) now with barge (4) making an approach to tug (t) to pass the side to which barge (3) is towed whereupon tug (t) passes a lead line to tug (1) to transfer tow of barge (3) to become part of the double tow by tug (1). Said lead line passed between tugs is the extension of an auxiliary short towline 131 which had replaced the normal towline as a performance undertaken in the interim of effecting barge exchange by tug (1). Said lead line passed to tug (1) also provides the means to haul aboard tug (1) the free towline aboard tug (t) now to be connected to the bow of tug (1) for reversal of identities tug (t) now the leader termed tug (1) with barge (2) next destined for exchange.
Figure 9:
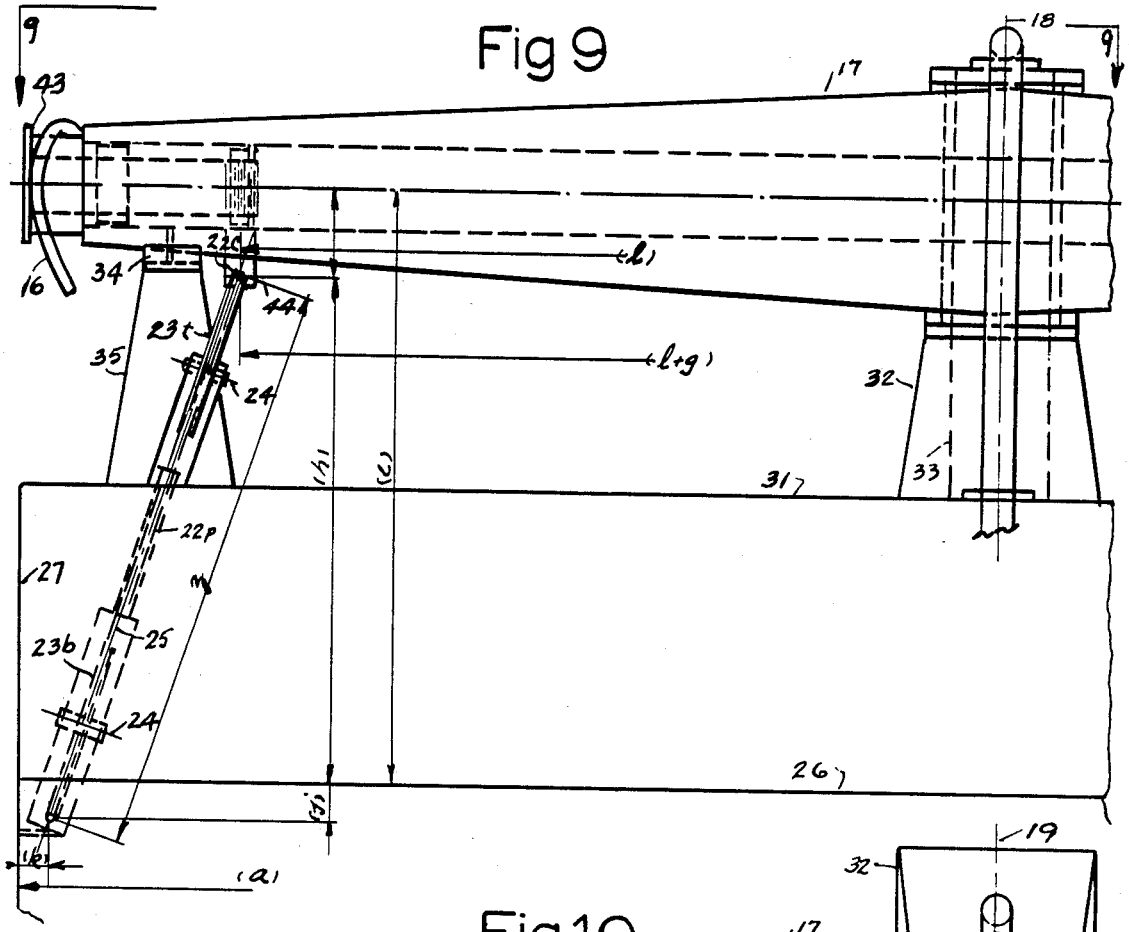
FIG. 9 is a partial elevational view (looking forward) of the pivotal beam and appurtenances taken from plane 10—10 of FIG. 10.
Figure 10:
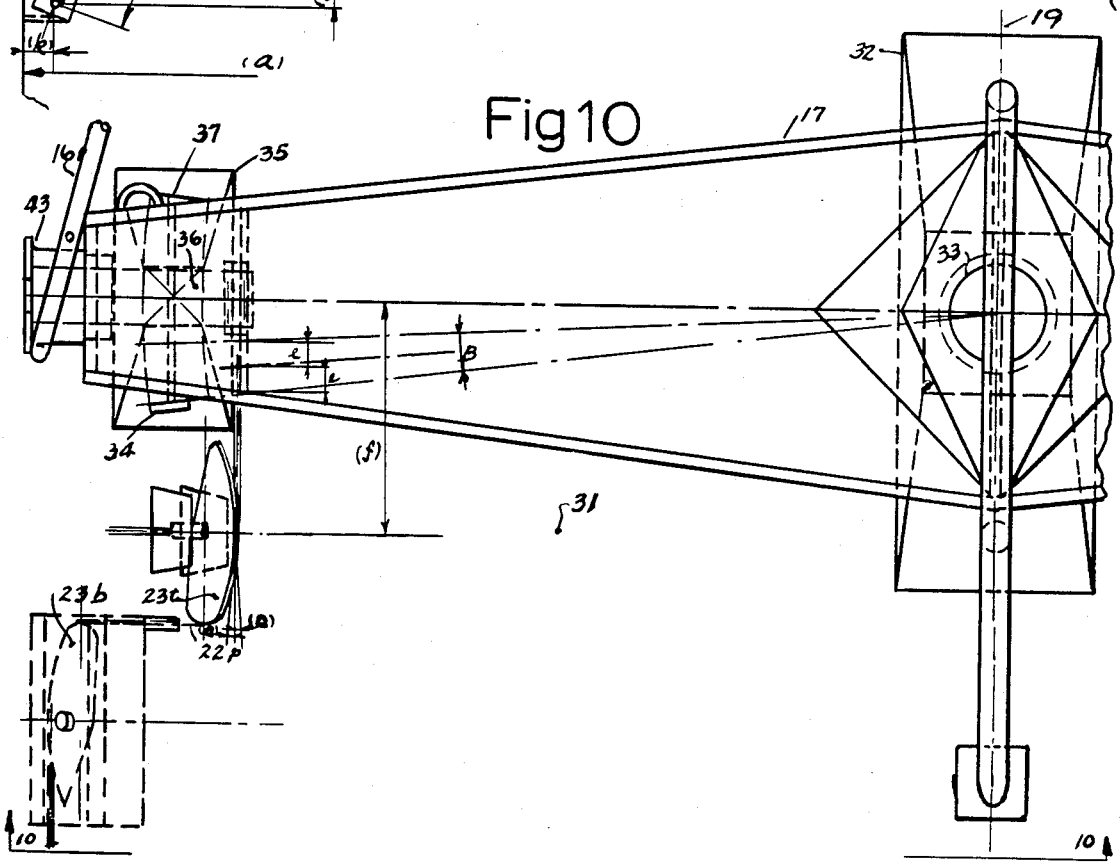
FIG. 10 is a partial plan view of the port side of the pivotal beam and appurtenance taken from plane 9—9 of FIG. 9.

'A' Frame 70, for Arrangement 5 FIG. 5, includes its special application, appurtenances and multi-purposes function to disclose an improved connection for more positive control of a barge than by conventional means of lashing a tug to a vessel. To facilitate making connection to help train the outboard reach of an 'A' frame to integrate the tug and barge, with both vessels variously loaded with resulting freeboard and differing in response to swells in calm waters, fail-safe means provides for a final registering of the distal clamp end 77 to a preselected heavy duty padeye 78.

The selective operated towlines draws the tug towards the barge, as attended, to also provide any required lateral movement, and wire 80 as the supporting means of the pivotally extended 'A' frame provides extended elevational movement with both attending respective the distantly observed wire fitted padeye connection at the barge stem. As noted before, the extendable wire portion 87 will have been recovered with the haul of vessels together (aft wire 84 length greater than 'A' frame length).

The Fail-Safe Means

The extendable second wire system 88 is attended with its use for arrangement (3) as the barge is alterably disposed aft of the tug and in that application is disassociated from the "A" frame. The line then is in sag suspension between its end mountings, with the said reel disposed adjacent with said stern deck rail. Observe that the distal end of the 'A' frame when prone is forward near to the tug house.

As the tow approaches a dock, the tug is gradually hauled in closer to the barge with the need then to make the 'A' frame operative. This requires a payout by the reel of at least twice the length of the 'A' frame to provide the loop reach to said house. Uncoupling second wire system 88 to slidingly engage aft wire 84 therethrough and recoupling wires establishes third wire assembly 188.

As wire 80 pivotally swings the 'A' frame outboard, then the said reel hauls in wire to retain the line sag to a least amount, said least amounts facilitates the shortening of the third wire system 188 at the instant of its need to be tensioned to provide any lateral or vertical force to said distal end. The pivotal mount easing the effort to provide elevational force; and, said lengthened lever arm easing the lateral force to turn the tug.

Summary of the Use of Four Systems

The crux of the matter pertaining to the 'A' frame and fail-safe means is to avoid consequences and liabilities of the conventional means to stop a barge (dropping the towline and bridle as a drag on the water bed; and, the unlikely means to control a barge by lashing the tug to it. The need to said integration is for the singular means to moor and to change barges at a dock.

The fail-safe means is outlined below since the disclosure of each system was detailed with coverage of associated appurtenances. First wire system 84 (inoperative), a suspended wire, connected between (a common to all systems) light-duty padeye 83 and flounder plate connection 85. Second wire system 88 (inoperative), a suspended wire, connected between said padeye 83 and the said reel at the tug stern rail. Used for Arrangement (3).

Third wire system 188 (operative) arranged like said second wire system 88, but slidingly linked with the open jawed clamp 77. The reel hauls in cable as the "A" frame is pivotally disposed outboard and the tug approaches the barge. Sag is gradually lessened to become taunt to telegraph at the reel a needed adjusted disposition of parts to mate. Eventually, the third wire system 188 is depended on to register the clamp, as eased by the pivotally balancing 'A' frame and the lengthened lever arm in reach to the tug resisting moment, to negate the effect of vessel motions. Used for Arrangement (5). Fourth wire system 184 (inoperative) arranged like said first wire system 84, but disposed also with the cufflink to the forecastle deck of a barge left at a dock.

Timing

A tow during a voyage may be represented as various time intervals - minutes to effect a barge exchange, hours in passage of coastal inlets, and days, even weeks at sea. Consequently, those said minutes are occupied in the haul together of vessels as said attended; so that the tensioning requirements of third wire system 188 is for seconds duration. Note further the negligible amount of bearing against assembly 188 to effect final registry with the pivotal arrangement for vertical adjustment and said lever length for the couple to turn the tug.

Purpose

With appurtenances established structurally and functionally, their application to facilitate changing arrangement is outlined as a sequence of acts. To change from arrangement (1) to arrangement (3), the sequence of acts comprises:

(a) Act 1—locating the flounder plate aboard and employing a cufflink to provide an interim fix together of bridle leg socket ends for a deck anchor means with the cufflink to assume tension in bridle legs with the towline slack;

(b) Act 2—removing pins from the flounder plate releases attachments thereto;

(c) Act 3—employing a lifting means, remove and dispose the flounder plate to a conveniently located securing fixture with said deck;

(d) Act 4—accommodating cufflink means provide for the mating connection together of distal ends of towlines and bridle legs for alterably extended bridle legs as dual towlines;

(e) Act 5—powering tractions winches to free said anchoring means and remove said interim fix of the cufflink therefrom; and, (f) Act 6—paying out said dual towlines for a required sternward barge position establishes said arrangement (3).

To change Arrangement (3) to Arrangement (2) said acts are adapted in reverse order and purpose. The correlation is established by symbolizing a 1/act (x) for the above significance in alphabetical order comprising;

(a) 1/Act 6—hauling in dual towlines to bring aboard said mating connection;

(b) 1/Act 5—employing the cufflink to establish said interim fix with the cufflink anchored allows the towline to be slacked off;

(c) 1/Act 4—removing pins disengages said mating connection of towlines and bridle legs;

(d) 1/Act 3—disposing the flounder plate adjacent with the cufflink to establish coincidence of bridle leg end connection and said vertex connection;

(e) 1/Act 2—connecting the bridle legs to the flounder plate by pins and said certain additional performance being the substitution by connecting to the flounder plate said auxiliary towline 131 disposed with wraps around said capstan 132 and having its free end therefrom extended by a hauling line which in turn is extended by a heaving line;

(f) 1/Act 1—simulating by powering the capstan to manually control the bridle load, casting the heaving line for capture by a second tug towing one barge allows release of said manual control, anchor means and lines for recovery by the second tug using its capstan to haul aboard the flounder plate with the cufflink anchoring then a fixed means;

(g) following the partial repeat of act 1 subsequent additional performance requires slacking off said auxiliary towline to be replaced by the free towline which when powered allows releasing said anchor and removing the cufflink for paying out of the towline for the double tow of barges; arrangement (2).

The aforegoing is believed to have clearly disclosed basic patent requirements to be novel, useful and operable; distinguishing the latter in the general description as the needed means to accomplish prescribed arrangements. Novelty is established by detailing arrangement of barges in accommodations with ports of call. Usefulness is demonstrated by self-reliance to adjust with confrontations at sea and coastal inlets to complete a voyage. Furthermore, this application reveals only preferred arrangements with each retaining the basic concept, applied to cope with changing requirements, for example: configuration of said aft wire, mounting and form of a rudder or conformation of vessel. Outfitting of tug and barge is understood to comply with the need for global voyages and coastal inlet passages. Provisions to cope with mishaps have been included as pertinent to the concept that voyages are completed unassistedly and unhindering to traffic.

What is claimed is:

1. A mode of operating a fleet of tugs and barges as outfitted to facilitate changes in arrangement between a tug and barge to suit encounters throughout a voyage, comprising:

(a) outfitting the tug with: a powered controllable pitch propeller; auxiliary power for a bow thrustor, a capstan with auxiliary towline, and dual traction winches each having a towline; an 'A' frame, pivotally mounted to the tug after deck stern rail; a travelling crane means to lift and move heavy parts; a portable derrick with a winch operated wire likewise mounted and adjacent to the 'A' frame; and, a reel contained extendable wire with the free end having a coupling means;

(b) outfitting the barge with: a mechanism transmitting towline tension to the barge and establishing corrective rudder as monitored by said arrangement, a first series of light duty padeyes at the barge stem for a selected aft one end connection of a stub length wire, heavy duty padeyes establish a second series with each one located immediate to and beneath a said light duty padeye, a pair of equal length, socket ended, pin connecting bridle legs oppositely arranged as connected to said mechanism with the other end extending forward of the barge, a flounder plate being the vertex connecting means between the towline distal end pin connecting means and said bridles, and featuring a cufflink with anchoring chain; and, (c) said arrangement and suitablity being:

Arrangement 1—a tug using one of its towlines for automatic control of a barge at sea;

Arrangement 2—a tug using its two towlines for double tow of arrangement 1;

Arrangement 3—a tug using two towlines for selective control of a barge in coastal inlets;

Arrangement 4—said above arrangements are adaptable by means to augment the rudder ability to turn a barge;

Arrangement 5—. An integrated tug and barge adapted only in sheltered waters as articulated to contend with conditioning forces and allow selective angular alignment between the tug and barge—a mooring requirement to exchange barges;

Arrangement 6—a triple tow of barges, an adaptation of arrangement 2, with redundancy by a second tug; and, said change to adapt the tow from arrangement 1 to arrangement 3 comprising:

(1) employing the flounder plate adapted with means to establish a span, from said vertex connection to said connection with the mechanism, selectively with equal measurement or slightly unequal measurement of oppositely arranged bridle legs while the alterable extension of a towline disposed the flounder plate from an aboard tug position to a selected distance aft of the tug;

(2) performing said change in arrangement by a sequence of acts comprising:

(a) Act 1—locating the flounder plate said aboard and employing a cufflink to provide an interim fix together of bridle leg socket ends for a deck anchor means with the cufflink to assume tension in bridle legs with the towline slack;

(b) Act 2—removing pins from the flounder plate releases attachments thereto;

(c) Act 3—employing a lifting means to remove and dispose the flounder plate to a conveniently located securing fixture with said deck;

(d) Act 4—accommodating cufflink means provide for the mating connection together of distal ends of towlines and bridle legs for alterably extended bridle legs as dual towlines;

(e) Act 5—powering traction winches to free said anchoring means and remove said interim fix of the cufflink therefrom; and, (f) Act 6—paying out said dual towlines for a required sternward barge position establishes said arrangement (3).

2. According to claim 1, adapting the tow from arrangement (3) to arrangement (2) constitutes in part a reverse order and purpose in applying said six acts with certain additional performances, comprising:

(a) 1/Act 6—hauling in dual towlines to bring aboard said mating connection;

(b) 1/Act 5—employing the cufflink to establish said interim fix with the cufflink anchored to allow the towline to be slacked off;

(c) 1/Act 4—removing pins disengages said mating connection of towlines and bridle legs;

(d) 1/Act 3—disposing the flounder plate adjacent with the cufflink to establish coincidence of bridle leg end connection and said vertex connection;

(e) 1/Act 2—connecting the bridle legs to the flounder plate by pins and said certain additional performance being the substitution by connecting to the flounder plate said auxiliary towline disposed with wraps around said capstan and having its free end therefrom extended by a hauling line which in turn is extended by a heaving line;

(f) 1/Act 1—simulating by powering the capstan to manually control the bridle load, casting the heaving line for capture by a second tug towing one barge allows release of said manual control, anchor means and lines for recovery by the second tug using its capstan to haul aboard the flounder plate with the cufflink anchoring means then fixed;

(g) following the partial repeat of act 1 subsequent additional performance requires slacking off said auxiliary towline to be replaced by the free towline which when powered allows releasing said anchor and removing the cufflink for paying out of the towline for the double tow of barges.

3. According to claim 1, the mode further comprising:

(a) adapting the flounder plate to provide the connection of the other end of said one end connected wire for an established first wire system for arrangements (1–2 and 6);

(b) disconnecting said other end from the flounder plate for coupling to said free end for an established second wire system for arrangement (3); and, (c) suiting said act 6 pay out the second wire system to sustain a sag in the suspended said second system.

4. According to claim 3 the mode further relates to the change from arrangement (3) to arrangement (5) comprising:

(a) erecting said derrick while selectively hauling-in on towlines to retrieve and uncouple said free end and to pay out said extendable portion for reening through a shackle connection to a remotely operable jaw type clamp as mounted to the distal end of the then deck disposed 'A' frame for a reconnected said other end and free end together to establish a third wire system as a fail-safe means associated with arrangement (5);

(b) using said winch wire, as elevationally disposed by said derrick, to pivotally swing the 'A' frame to reach outboard of the tug for an adjusted elevational clamp alignment with the established said heavy duty padeye and with said selected hauling-in directing the open jawed clamp in lateral alignment with said established padeye;

(c) reeling-in accumulating lengthening of said third wire system to suit hauling-in and maintain a like said sag makes operative the third wire system as the fail-safe means to negate disruptive buoyant vessel motions;

(d) bearing of clamp jaws to said established padeye signals the remote released to set the clamp providing a universal joint and inextensible integration of tug and barge with the 'A' frame approximate midlength semi-supported by said winch wire tension established by a counterweight means;

(e) providing a catwalk part of said 'A' frame enables a crewmember to pass to and from said tug and barge prior to docking to monitor gear commonly used therewith, to ready a barge for sea and to alter said one end connection to suit a subsequent disposition of 'A' frame end universal connection;

(f) maneuvering the tug fore and aft by said controllable pitch propeller and laterally by said bow thrustor as a pivotal swing of the lengthened tug respective said universal joint for selective angular alignment with the barge enables the tug to jackknife the barge to a dock as assisted by dock lines conventionally disposed;

(g) pending departure of the tug in the exchange of barges a repeat of the reverse order of said acts provides now for said heaving line to be cast now to the forecastle deck of the barge being left to dispose flounder plate and cufflink coupled together bridle legs hauled thereto and ready for transfer to another tug; and, (h) exchanging connection of said other end from said free end to said cufflink employed in reverse of act 5 establishes a fourth wire system as inoperatively disposed to said forecastledeck.

* * * * *